US008833154B2

(12) United States Patent
Skillingstad

(10) Patent No.: US 8,833,154 B2
(45) Date of Patent: Sep. 16, 2014

(54) TRACER IDENTIFICATION OF DOWNHOLE TOOL ACTUATION

(75) Inventor: Torger Skillingstad, Bru (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 373 days.

(21) Appl. No.: 13/271,817

(22) Filed: Oct. 12, 2011

(65) Prior Publication Data

US 2013/0091943 A1 Apr. 18, 2013

Related U.S. Application Data

(60) Provisional application No. 61/394,564, filed on Oct. 19, 2010.

(51) Int. Cl.
*E21B 47/10* (2012.01)
*E21B 34/14* (2006.01)

(52) U.S. Cl.
CPC ..... *E21B 47/1015* (2013.01); *E21B 34/14* (2013.01)
USPC ..... 73/152.18; 166/250.12

(58) Field of Classification Search
USPC ..... 73/152.14, 152.18; 166/250.12, 252.6; 436/27
See application file for complete search history.

(56) References Cited

U.S. PATENT DOCUMENTS 3,116,450 A * 12/1963 Longwill ..... 324/324
3,818,227 A * 6/1974 Fries ..... 250/303
3,991,827 A * 11/1976 Schall ..... 166/253.1
4,008,763 A * 2/1977 Lowe, Jr. ..... 166/253.1
4,264,329 A * 4/1981 Beckett ..... 436/27
4,420,565 A * 12/1983 Schmitt ..... 436/27
5,892,147 A * 4/1999 Garnes et al. ..... 73/152.14
6,349,766 B1 2/2002 Bussear et al.
6,645,769 B2 * 11/2003 Tayebi et al. ..... 436/56
6,672,385 B2 1/2004 Kilaas et al.
8,230,731 B2 * 7/2012 Dyer et al. ..... 73/152.18
8,322,414 B2 * 12/2012 Al-Gouhi et al. ..... 166/250.12
2001/0036667 A1 * 11/2001 Tayebi et al. ..... 436/56
2006/0054317 A1 * 3/2006 Clark et al. ..... 166/250.01
2008/0262737 A1 10/2008 Thigpen et al.
2010/0108148 A1 5/2010 Chen et al.
2012/0175109 A1 * 7/2012 Richard ..... 166/250.12
2012/0227962 A1 * 9/2012 Richard ..... 166/250.12

OTHER PUBLICATIONS

International Search Report and Written Opinion issued in PCT/US2011/056536 on Jun. 25, 2012, 9 pages.

* cited by examiner

*Primary Examiner* — John Fitzgerald

(74) *Attorney, Agent, or Firm* — Patrick A. Traister; Brandon S. Clark

(57) ABSTRACT

A technique provides a system and method utilizing a well system having a plurality of tools with actuatable components. The well system also comprises tracer elements which are unique with respect to corresponding tools of the well system. The tracer elements are positioned and oriented to open when physically engaged by the actuatable component of a corresponding tool. Released tracer material from the tracer element may be detected to confirm actuation of a specific tool in the well system.

19 Claims, 2 Drawing Sheets

TRACER IDENTIFICATION OF DOWNHOLE TOOL ACTUATION

CROSS-REFERENCE TO RELATED APPLICATION

The present document is based on and claims priority to U.S. Provisional Application Ser. No. 61/394,564, filed Oct. 19, 2010, incorporated herein by reference.

BACKGROUND

Inflow control device technology has been employed to improve hydrocarbon recovery in a variety of wells, including horizontal wells. Adaptive inflow control device systems can improve sand face completion functionality while also providing more control over the reservoir in case of unexpected events. The increased functionality may include selective closing and opening of individual inflow control device units and selective changes of position/flow area for individual inflow control device units. However, difficulties arise in confirming actuation of specific inflow control devices. In various injector and producer wells, tracer technology has been employed to detect reservoir inflow and the allocation/contribution from well zones, but such systems have not been able to indicate tool actuation.

SUMMARY

In general, the present disclosure provides a system and method in which a well system has a plurality of tools with actuatable components. The well system also comprises tracer elements which are unique with respect to corresponding tools of the well system. The tracer elements are positioned and oriented to open, e.g. fracture, when physically engaged by the actuatable component of a corresponding tool. Released tracer material from the tracer element may be detected to confirm actuation of a specific tool in the well system.

BRIEF DESCRIPTION OF THE DRAWINGS

Certain embodiments will hereafter be described with reference to the accompanying drawings, wherein like reference numerals denote like elements. It should be understood, however, that the accompanying figures illustrate only the various implementations described herein and are not meant to limit the scope of various technologies described herein, and.

DETAILED DESCRIPTION

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a system and methodology which facilitate determination of downhole tool actuation. According to one embodiment, a plurality of tools may be deployed in a downhole completion. Each tool may be actuated between operational positions via shifting of an actuatable component. Tracer elements are uniquely associated with the plurality of tools and are individualized to indicate actuation of specific tools. For example, each tracer element may be unique relative to a corresponding tool and positioned for opening, e.g. fracturing, when the tool is shifted to a different operational position. The tracer element may be positioned in the path of movement of the actuatable component such that actuation of the tool causes the actuatable component to fracture or otherwise open the tracer element and to release unique tracer material which may be detected as a confirmation of that specific tool being actuated.

In some applications, the downhole tools may comprise adaptive inflow control devices which may be individually cycled through various stages or steps of functionality. Placement of the unique tracer elements with corresponding inflow control devices provides confirmation that specific, individual inflow control devices have been switched to their next position or function without requiring downhole sensors or electrical/wireless communication links with the surface.

In general, the tracer elements may be designed to release tracers, including firm or chemical substances, downhole in a well completion. The tracer material flows upwardly to the surface and provides confirmation that a downhole tool has been actuated correctly and changed to its next operational configuration. In some embodiments, the tracer elements are pre-installed in or adjacent the downhole tools. Actuation of a downhole tool causes a shiftable/actuatable component of the downhole tool to mechanically move into engagement with the tracer element and to open the tracer element so that tracer material unique to that specific downhole tool is released. By way of example, the tracer element may be opened via mechanical fracturing of the tracer element. The fracturing may comprise shaving off tracer material particles into, for example, completion tubing so that the tracer material particles can be transported to a surface detector with the flow of well fluid. Other methods of fracturing the tracer element and releasing the tracer material may include puncturing of the tracer element or breaking of a frangible tracer element.

Figure 1:
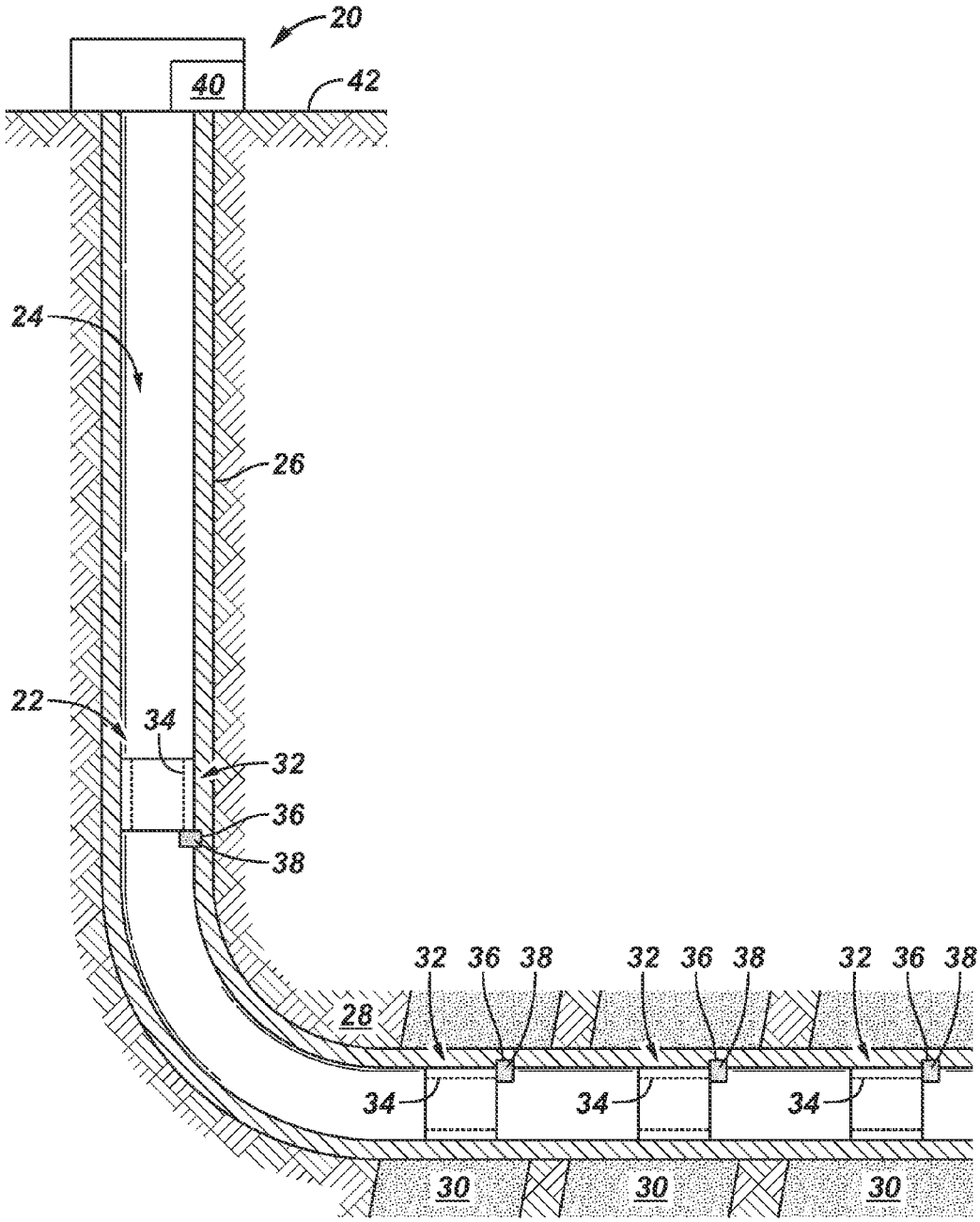
FIG. 1 is a schematic illustration of an example of a well system comprising a plurality of well tools and tracer elements which indicate actuation of specific well tools, according to an embodiment of the disclosure.

Referring generally to FIG. 1, an example of one type of application utilizing a plurality of downhole tools and corresponding tracer elements is illustrated. The example is provided to facilitate explanation, and it should be understood that a variety of well completion systems and other well or non-well related systems may utilize the methodology described herein. The downhole tools and corresponding tracer elements may be located at a variety of positions and in varying numbers along the well completion or other tubular structure.

In FIG. 1, an embodiment of a well system 20 is illustrated as comprising downhole equipment 22, e.g. a sand screen or other type of well completion, deployed in a wellbore 24. The downhole equipment 22 may be part of a tubing string or tubular structure 26, such as production tubing or well casing, although the tubular structure 26 also may comprise many other types of well strings, tubing and/or tubular devices. Additionally, downhole equipment 22 may include a variety of components, depending in part on the specific application, geological characteristics, and well type. In the example illustrated, the wellbore 24 comprises a generally vertical section of the wellbore and a deviated, e.g. horizontal, section of the wellbore containing downhole equipment 22. However, various well completions and other embodiments of downhole equipment 22 may be used in a well system having other types of wellbores, including deviated, e.g. horizontal, single bore, multilateral, cased, and uncased (open bore) wellbores.

In the example illustrated, wellbore 24 extends down through a subterranean formation 28 having a plurality of well zones 30. The downhole equipment 22 comprises a plurality of tools 32 associated with the plurality of well zones 32. By way of example, the tools 32 may comprise well tools in the form of inflow control devices. For example, individual inflow control devices 32 may control flow from the surrounding well zones 30 and into tubular structure 26, e.g. production tubing. Each of the illustrated tools 32 comprises an actuatable component 34, e.g. a sliding sleeve. However, tools 32 may comprise a variety of other types of actuatable components, including pistons, balls, and pins. In a variety of applications, downhole equipment 22 is a sand screen and tools 32 control inflow of fluid into the sand screen 22.

As illustrated, each tool 32 is associated with a corresponding tracer element 36. Each tracer element 36 is unique relative to the other tracer elements 36, and each tracer element is positioned such that actuation of the corresponding tool 32 causes the tracer element 36 to open and release a tracer material 38. By way of example, the tracer element 36 may be fractured, e.g. mechanically fractured, to release the tracer material 38. The tracer material 38 flows through tubular structure 26 via, for example, well fluid flow to a detector or detection system 40. By way of example, the detector 40 may be located at a surface location 42 to eliminate the need for downhole electronics and sensors otherwise needed to communicate data related to the downhole well tools 32. The tracer elements 36 and detector 40 are well-suited to complement well tools 32 (such as adaptive inflow control devices) but the system and methodology can be used with many other types of downhole devices to provide feedback/confirmation on configuration changes involving mechanical movements.

The detector 40 may be designed to collect and/or identify and categorize the tracer material 38 released via actuation of specific well tools 32. Well system 20 may be set up so that during installation each tracer element 36 comprises a unique tracer material 38 relative to the other tracer elements 36. For example, the tracer element 36 associated with the first or most distal well tool 32 is unique in that it comprises a unique tracer material 38. Release and detection of the unique tracer material 38 indicates actuation of that specific, most distal well tool 32. Similarly, the other tracer elements 36 associated with the next sequential well tools 32 are each unique in that they each comprise a unique tracer material 38 associated with the specific corresponding well tool 32. In at least some applications, each tracer element 36 is unique in that it contains a uniquely identifiable chemical 38 relative to the chemical/tracer material associated with each of the other well tools 32 along the entire tubular structure 26, e.g. completion string.

Figure 2:
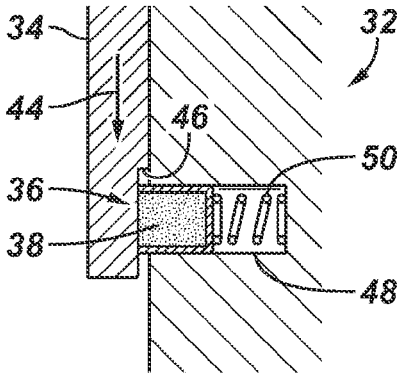
FIG. 2 is a schematic illustration of an actuatable component of a well tool engaging an embodiment of a tracer element, according to an embodiment of the disclosure.

Referring generally to FIG. 2, an embodiment of well tool 32 and the corresponding tracer element 36 is illustrated. In this embodiment, the tracer element 36 is selectively fractured to release tracer material 38. The tracer element 36 comprises tracer material 38 and is positioned in line with movement of actuatable component 34 of well tool 32. (The tracer material 38 may be a substance formed of particles that can be dislodged.) Thus, when well tool 32 is actuated, the actuatable component 34 is moved in the direction of arrow 44 and shaves off particles of tracer material 38 via a shaving edge 46. By way of example, the tracer material 38 may be slidably positioned within a recess 48 formed within the well tool 32 or within an adjacent housing. A spring member 50 may be used to bias the tracer material 38 into a position for shaving of tracer material particles upon actuation of well tool 32.

Figure 3:
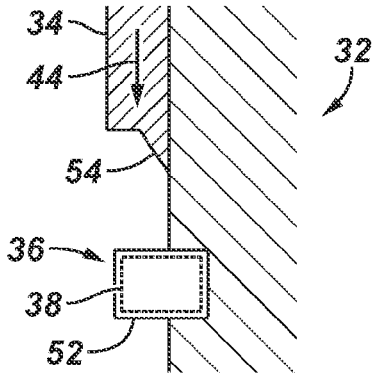
FIG. 3 is a schematic illustration of an actuatable component of a well tool engaging another embodiment of a tracer element, according to an alternate embodiment of the disclosure.

Another embodiment of tracer element 36 is illustrated in FIG. 3. In this embodiment, tracer element 36 comprises a container 52 containing tracer material 38 which may be in, for example, liquid or granular form. The actuatable component 34 may comprise a piercing end 54 aligned to fracture container 52 and release tracer material 38 when the well tool 32 is actuated. During actuation of the well tool 32, actuatable member 34 is moved in the direction of arrow 44 and piercing end 54 fractures, e.g. perforates, container 52.

Figure 4:
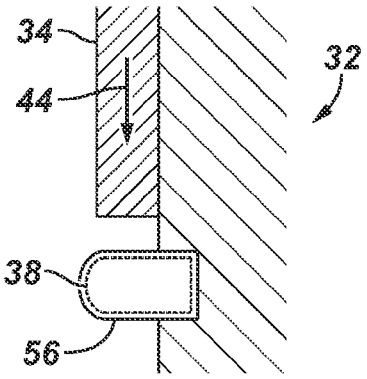
FIG. 4 is a schematic illustration of an actuatable component of a well tool engaging another embodiment of a tracer element, according to an alternate embodiment of the disclosure.

In the embodiment illustrated in FIG. 4, tracer element 36 comprises a frangible member 56, such as a frangible container, which breaks when engaged by actuatable component 34 during actuation of the well tool 32. During shifting of component 34 in the direction of arrow 44, the actuatable component breaks frangible member 56 and releases tracer material 38. As with the other embodiments, the tracer material 38 is carried by flowing well fluid up through tubular structure 26 to detector 40 which determines/confirms actuation of that specific well tool 32.

Depending on the type of well tool 32 and the type of application in which well tool 32 is utilized, a plurality of tracer elements 36 may be installed at each well tool 32. For example, if well tool 32 comprises a multi-position well tool, the plurality of tracer elements 36 may comprise different types of tracer materials 38 to provide an indication/confirmation of the specific position to which the well tool 32 has been actuated. The different types of tracer materials 38 are released independently of each other when the specific tracer elements 36 are fractured due to movement of the multi-position tool 32 to a specific configuration.

Figure 5:
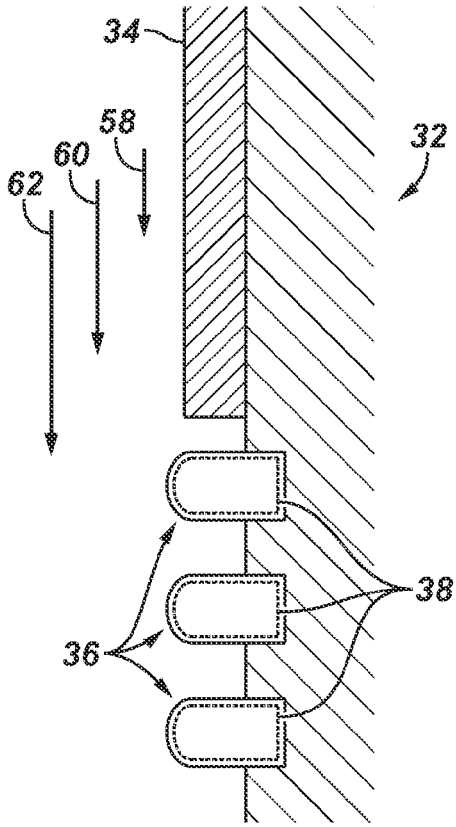
FIG. 5 is a schematic illustration of an actuatable component of a well tool engaging another embodiment of a tracer element, according to an alternate embodiment of the disclosure.

As illustrated in the embodiment of FIG. 5, for example, tool 32 is a multi-position tool which may be shifted to a plurality of different settings indicated by arrows 58, 60 and 62, respectively. The plurality of tracer elements 36 are positioned for independent fracturing as the actuatable component 34 is moved to sequential positions during actuation of the multi-position well tool 32. Each of the plurality of tracer elements 36 comprises a unique tracer material 38 which is released upon fracture to indicate actuation of the well tool 32 to a specific position.

Furthermore, the system and methodology may be employed in non-well related applications which require actuation of devices at specific zones along a tubular structure. Similarly, the system and methodology may be employed in many types of well applications, including a variety of adaptive inflow control device systems. However, other types of valves and actuatable component can be combined with tracer elements in a variety of forms and configurations. The tracer elements also may comprise many types of tracer materials in the form of liquids, grains, dissolvable materials, and other chemicals or materials detectable by detection system 40. The number and arrangement of tracer elements positioned along the tubular structure also can vary substantially from one type of application to another.

Although only a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for determining actuation of tools downhole, comprising:

a plurality of tools deployed along a sand screen within a wellbore, each tool of the plurality of tools having an actuatable component which may be shifted between operational positions; and a plurality of tracer elements in which each tracer element is unique relative to the other tracer elements, each tracer element being associated with a corresponding tool of the plurality of tools and being positioned such that actuation of the corresponding tool mechanically opens the tracer element and releases tracer material for detection.

2. The system as recited in claim 1, further comprising a detector positioned at a surface location to detect the tracer material as it flows up through the wellbore.

3. The system as recited in claim 1, wherein the plurality of tools comprises a plurality of inflow control devices.

4. The system as recited in claim 1, wherein at least one tool is a multiposition tool associated with a plurality of tracer elements which indicate tool position upon fracture.

5. The system as recited in claim 1, wherein the tracer element is fractured by movement of the actuatable component.

6. The system as recited in claim 5, wherein the actuatable component comprises a sliding sleeve.

7. The system as recited in claim 5, wherein a portion of the tracer element is shaved off via movement of the actuatable component to release particles of the tracer material.

8. The system as recited in claim 5, wherein the tracer element is punctured via movement of the actuatable component to release the tracer material.

9. The system as recited in claim 5, wherein the tracer element is frangible and broken via movement of the actuatable component to release the tracer material.

10. A method for determining actuation of downhole tools, comprising:

selecting tracer elements which are individually unique with respect to corresponding tools disposed along a sand screen;

positioning each tracer element for physical engagement by an actuatable element of the corresponding tool associated with that tracer element;

delivering the tracer elements and corresponding tools downhole into a wellbore; and actuating at least one of the corresponding tools, thus fracturing the tracer element unique to that corresponding tool and releasing a tracer material.

11. The method as recited in claim 10, wherein actuating comprises shaving off particles of the tracer material from the tracer element.

12. The method as recited in claim 10, wherein actuating comprises perforating the tracer element to release the tracer material.

13. The method as recited in claim 10, wherein actuating comprises breaking a frangible tracer element to release the tracer material.

14. The method as recited in claim 10, wherein actuating comprises actuating sliding sleeves of downhole inflow control devices.

15. The method as recited in claim 10, further comprising flowing the tracer material, released via fracturing the tracer element, to a surface location.

16. The method as recited in claim 15, further comprising detecting the tracer material at the surface location and, based on the detection, determining which of the corresponding tools was actuated.

17. A method, comprising:

providing a well completion with tracer elements and corresponding tools having actuatable components oriented to mechanically open the tracer elements upon actuation; actuating each of the corresponding tools such that the actuatable component of each too fractures the tracer element associated with the corresponding tool and delivering the well completion downhole into a wellbore.

18. The method as recited in claim 17, wherein providing comprises providing a plurality of unique tracer elements for at least one individual corresponding tool of the corresponding tools to determine an actuation position of the at least one individual corresponding tool based on the release of tracer material.

19. The method as recited in claim 17, wherein actuating comprises actuating sliding sleeves.

* * * * *